US007708178B2

(12) United States Patent
Bassett

(10) Patent No.: US 7,708,178 B2
(45) Date of Patent: May 4, 2010

(54) HANDHELD PNEUMATIC TOOL FOR BREAKING UP ROCK

(76) Inventor: Carroll Bassett, HC68 Box 64B, Friars Hill, WV (US) 24938

( * ) Notice: Subject to any disclaimer, the term of this patent is extended or adjusted under 35 U.S.C. 154(b) by 0 days.

(21) Appl. No.: 11/817,942

(22) PCT Filed: Mar. 6, 2006

(86) PCT No.: PCT/US2006/007866

§ 371 (c)(1),
(2), (4) Date: Sep. 6, 2007

(87) PCT Pub. No.: WO2006/096615

PCT Pub. Date: Sep. 14, 2006

(65) Prior Publication Data

US 2008/0185904 A1 Aug. 7, 2008

Related U.S. Application Data

(60) Provisional application No. 60/594,037, filed on Mar. 7, 2005.

(51) Int. Cl.
*E21C 37/12* (2006.01)

(52) U.S. Cl. ..... 227/130; 227/131; 227/113; 173/212; 173/169

(58) Field of Classification Search ..... 227/130, 227/131, 113; 173/212, 169
See application file for complete search history.

(56) References Cited

U.S. PATENT DOCUMENTS

| | | | | |
|---|---|---|---|---|
| 3,583,496 | A * | 6/1971 | Fehrs | 173/15 |
| 3,584,776 | A * | 6/1971 | Bolte | 227/130 |
| 3,788,195 | A * | 1/1974 | Lange | 91/457 |
| 3,901,130 | A * | 8/1975 | Lange | 91/461 |
| 5,480,088 | A * | 1/1996 | Braun et al. | 227/130 |
| 2008/0265189 | A1 * | 10/2008 | Bravo | 251/63.5 |

* cited by examiner

*Primary Examiner*—Brian D Nash
(74) *Attorney, Agent, or Firm*—Johnston Holroyd; Mary-Jacq Holroyd

(57) ABSTRACT

A tool (12) has a body (14) having an opening (16) forming a barrel (18) which has a top and a bottom (20 and 22), an opening (30) at the bottom (22), and a pressure input (44) for fluid communication. The barrel (18) receives a piston (24) and a magnet (23) which is contiguous with the pressure input (44). An actuator pin tube (26) is received in the opening (30) at the bottom (22) of the barrel (18), and an actuator pin (38) is engaged in the tube (26). A second opening (28) may be disposed in the top (20). A kit (110) containing the tool (12), hose (94), cartridges (84) and a pump (P). A method for using the tool (12) is also contemplated hereby. Multiple tools (12) may be detonated at the same time by hooking them up to a manifold (95 or 95').

24 Claims, 8 Drawing Sheets

HANDHELD PNEUMATIC TOOL FOR BREAKING UP ROCK

RELATED APPLICATIONS

This application claims the benefit of U.S. Provisional Application Ser. No. 60/594,037 entitled "HANDHELD PNEUMATIC TOOL FOR BREAKING UP ROCK" filed on Mar. 7, 2005, the contents of which are incorporated herein by reference in its entirety.

BACKGROUND OF THE INVENTION

Numerous devices have been utilized in the art of breaking up rock. Most such devices are quite large, and are used in mining, quarries and excavation endeavors. These devices and methods are typically for large-scale efforts resulting in massive explosions, and the destruction or generation of large areas of broken rock. Few devices exist for specialized small scale breaking efforts; however, these devices tend to be larger than the present device, utilize far more explosive force and dollar.

For example, U.S. Pat. No. 5,789,694 ('694) shows a tool and method for breaking up rock. The tool of '694 has a barrel, a breech body for receiving a gas discharge cartridge loaded with gas producing propellant and a firing-handle mechanism (a firing pin) for firing the cartridge. The method involves drilling a hole in rock, filling the hole with water, passing the barrel down the hole, and firing the cartridge. The cartridge used is similar to a shotgun cartridge and has a rim-fire percussion cap, which complements the firing pin. In operation, the barrel is inserted into a water-filled hole while the cartridge, which is engaged at the top of the barrel opposite the bottom of the hole, is detonated by the firing pin thereby producing rapid gas expansion into the water generating shock waves throughout the water and fracturing of the rock. The device additionally uses a blast shield.

The explosive gas cartridge of the '694 invention is placed in the middle of the device at the top of the barrel. The barrel of the '694 patent is used as a pipe for channeling the force of the detonated gas chamber into the bottom of the borehole. The device of '694 requires a blast shield indicating the great force released thereby. A smaller device, which has a smaller explosion, is desired so that the device may be used in circumstances not conducive to most explosions.

Many related art devices involve methods that require drilling boreholes and generating a rapid increase in the concentration of pressure in the bottom of a borehole either by explosions, or a sudden increase in fluid pressure, to facilitate and propagate fracturing of the rock. Many of these inventions are designed to excavate rocks or dig tunnels, and include various boom-supported devices. All of these devices use impact and expansive gas in order to break apart rock or other hard material. These devices are quite large and produce substantial explosions/gas expansions, and are otherwise unsuitable for the purposes of the present invention. The majority of the related art uses large-scale devices, which are disposed on boom arms.

Methods of breaking up rock which couple explosive (or rapid gas expansion) and mechanical impact breaking to excavate rock and dig tunnels are well known. U.S. Pat. No. 5,803,550 ('550) discloses a method for breaking rock using small-charge blasting techniques followed by a mechanical impact breaker. In the small-charge blasting technique, a gas is released into the bottom of a sealed hole. The gas pressure rises rapidly in the hole until the gas pressure causes the hard material to fracture followed by an impact breaker to complete the fracturing of the rock and to remove the fractured material. The '550 device involves a large mobile undercarrier having a boom assembly with a mechanical impact breaker and a small charge blasting apparatus attached thereto. It is desirable to have a very small charge blasting technique that is effective without using an impact breaker to increase the fracture of the rock generated by the detonation of the load. Similarly, U.S. Pat. No. 5,308,149 ('149) uses a controlled-fracturing process accompanied by pressurizing the bottom of a drill hole in such a way as to initiate and propagate a controlled fracture. The process of '149 uses a large apparatus to operate.

U.S. Pat. No. 6,145,933 ('933) describes a method for removing hard rock by a combination of impact hammers and small charge blasting. The method of '933 uses small-charged blasting techniques followed by a mechanical impact breaker. In the small-charge blasting technique of the '933 patent, a gas is released into the bottom of a sealed hole located at a free surface of the rock. The gas pressure rises rapidly in the hole until the gas pressure causes the rock to fracture. A blasting agent may be used to cause initial subsurface fractures. An impact breaker is then used to complete fracturing and removal of the material. The devices utilized in the invention of '933 are large scale and are held into position by boom arms.

It is known in the art to seal or block the bore hole to increase the pressure at the bottom of the hole without using additional impact apparatuses. U.S. Pat. No. 6,148,730 describes a method and apparatus for controlled small-charge blasting by pressurization of the bottom of a drill holes The invention therein involves drilling a hole in rock, inserting a cartridge containing an explosive apparatus, bracing the cartridge with a massive stemming bar in the drilled hole, and detonating the explosive thereby generating fractures in the rock. Likewise, U.S. Pat. No. 6,035,784 discloses a method and apparatus for controlled small-charge blasting of hard rock explosive pressurization of the bottom of a drill hole which uses a cartridge containing an explosive charge inserted into the bottom of a drilled hole wherein the cartridge is held in place by a massive stemming bar. The stemming bar also serves to partially block the hole increasing the pressure of the explosion.

U.S. Pat. No. 5,765,923 teaches a cartridge for generating high-pressure gases in a drilled hole. The cartridge includes a base member, a body member, a propellant, and a device for sealing a surface of the cartridge to the surface of a hole in the material. Upon ignition of the propellant, gas pressure rapidly rises in the hole due to the sealing device. The gas pressure causes the material to form a penetrating cone fracture. The cartridge is placed in a hole by a boom suspended from large-scale equipment. In operation, the cartridge is first loaded into a combustion chamber and a gas injector barrel is placed into the drill hole. A firing pin is actuated thereby triggering the primer which in turn ignites the propellant. As the propellant burns, pressure is built up within the cartridge. At a desired psi (pounds per square inch), the cartridge body ruptures releasing the generated gas into the combustion chamber and the barrel.

Many related art devices and methods involve apparatuses that insert explosives into a hole using a boom, which explosives may then be detonated remotely. Additionally, the boom arm may serve to partially seal the hole. U.S. Pat. No. 3,721,471 shows a drill-and-blast module which is disposed on the end of a boom for insertion in a hole and detonation thereof. U.S. Pat. No. 5,098,163 ('163) discloses a controlled fracture method for breaking hard compact rock which involves a boom supported apparatus that inserts an explosive, or a propellant charge, in a pre-drilled hole. The '163 apparatus may utilize a barrel to insert the explosives, and the hole may be sealed behind the explosive in an effort to control the explosion.

Furthermore, it is well known to use devices and methods, which increase fluid pressure by means other than explosive or rapid gas expansion, to break apart the rock. U.S. Pat. No. 4,669,783 teaches a process and apparatus for fragmenting rock using an explosion-free pulse of water directed into a borehole resulting in high-pressure shock waves that fractures the rock. U.S. Pat. No. 6,375,271 describes a controlled foam injection system for fragmentation of hard compact rock whereby a high pressure foam is inserted into a drill hole by a barrel, which seals the hole and is disposed at the end of a boom attached to heavy equipment.

Alternative detonation techniques and hybrid methodologies are also known. U.S. Pat. No. 2,058,099 describes a blasting cartridge that is inserted into a drill hole. High water pressure is exerted on the cartridge through a pipe resulting in a sudden explosive release of pressure increasing substance from the cartridge. U.S. Pat. No. 5,803,551 ('551) discloses a method, apparatus and cartridge, which are disposed on a boom truck, for non-explosive rock fragmentation. The '551 method involves first drilling a hole into a rock, positioning a charging system having a propellant cartridge inserted therein, which cartridge has a propellant and means for igniting the propellant, and forcing the propellant cartridge through the charging system and into the hole to ignite the propellant.

U.S. Pat. No. 6,318,272 teaches a method of breaking rock, which includes drilling a hole in the rock by a drilling machine having an articulated boom and a drilling tool at the end of the boom. After removing the drilling tool, a rock breaking charge is charged into the hole, which charge includes a propellant, a fuse head, and a tamping medium contained in a casing. The tamping medium is discharged into the hole and allowed to set around and rearward of the propellant. The driving mechanism is removed and the propellant is actuated from a remote position via electrical charge or the like.

U.S. Pat. No. 4,508,035 involves an explosive charging apparatus for rock drilling which charges a controlled amount of explosives sequentially to bores drilled in a rock surface and includes an explosive charging pipe, a boom mechanism carrying the explosive charging pipe, boom actuators, a control circuit and an explosive charging pipe. U.S. Pat. No. 5,611,605 describes a method, apparatus and cartridge for non-explosive rock fragmentation which involves drilling a hole into a rock, and inserting a propellant cartridge into a charging housing with a means for igniting the propellant, and forcing the propellant cartridge through a charging hose and into the hole to ignite the propellant. The apparatus and cartridge of '605 are inserted using a boom device.

It is known to use pressurized fluids in a hole to break rocks. U.S. Pat. No. 6,339,992 ('992) shows a small charge blasting apparatus including an apparatus for sealing pressurized fluids in holes. The invention therein provides a relief volume for a pressurized working fluid in the bore of a barrel that is inserted into a hole in the material to be broken. The invention seals the fluid into the hole while a gas-generator generates greater pressure. The requirement of a separate apparatus for sealing pressurized fluids into bore holes is inconvenient especially in any emergency rescue operations where the least amount of equipment, especially bulky equipment, in most desirable.

Numerous diverse methods and apparatuses have been developed to aid in breaking rock and other hard surfaces. U.S. Pat. No. 5,573,307 ('307) describes a method and apparatus for blasting hard rock using a highly insensitive energetic material ignited with a moderately high-energy electrical discharge causing the fracturing and break up of hard rock. The blasting apparatus of '307 has a reusable blasting probe which includes a high voltage electrode and a ground return electrode separated by an insulating tube. The two electrodes of the blasting probe are in electrical contact with a metal powder and oxidizer mixture that will generate an exothermic reaction upon generation of an electric current therebetween creating a gas expansion to fracture the rock.

U.S. Pat. No. 2,587,243 ('243) describes a cutting apparatus, which produces a very high velocity gaseous penetrating jet for cutting materials or objects using a chemical charge. No borehole is drilled prior to the use of the '243 apparatus. U.S. Pat. No. 3,208,381 shows a device for loading bore holes with explosives in bar-shaped or tubular packages, which device is a generally tubular sleeve constructed of resilient material to receive one end of an explosive package.

A variety of cartridges are used in the related art. Cone-shaped blasting cartridges or plugs are designed to contain or control the explosion in a drilled/bore hole. U.S. Pat. No. 5,705,768 shows a shaped charge to be placed into a bore hole, which shaped charge includes an elongate housing having a concave recess in an upper end, an explosive located within the housing and below the recess, and a detonator positioned beneath the recess and explosive.

Similarly, U.S. Pat. No. 2,296,504 ('504) teaches a blasting plug designed to control the level of explosion resulting from the detonation of dynamite, and prevent an uncontrolled explosion and resultant fire hazard. The method of using the device of '504 involves inserting the device in a borehole and detonating the device remotely. U.S. Pat. No. 5,900,578 describes a method of breaking slabs that involves drilling bore holes along a desired break line, inserting a detonating cord therein, filling the bore holes with a shock transmitting/moderating composition, and detonating the detonation cord.

U.S. Pat. No. 1,585,664 ('664) shows a method and apparatus for breaking rock which utilizes projectiles (similar to bullets) and a forcible ejection means attached to a boom. The projectiles are fired at the surface of the rock. The '664 invention demonstrates that the use of bullet-like explosives is known in the art. U.S. Pat. No. 5,069,130 describes a propellant igniter. U.S. Pat. No. 4,900,092 discloses a barrel for a rock breaking tool and method for breaking rock which involves drilling a hole in rock, filling the hole with water, inserting a short barrel of a rock breaking tool into the hole entrance, covering the tool with a recoil restraining mat, and discharging a cartridge down the barrel.

None of the above inventions and patents, taken either singularly or in combination, is seen to describe the instant invention as claimed. Specifically, these devices lack the simplicity and portability desired for truly small-scale rock breaking, and especially, for rock breaking that must not generate an explosion of any significant force.

SUMMARY OF THE INVENTION

The present invention relates to a tool designed for the small scale cracking and demolition of solid materials, including but not limited to rock and masonry. In particular the present invention relates to a remote pneumatic detonation tool that is used in splitting off part of a rock or other hard material. The term "rock" when used herein shall include any suitable hard material, such as concrete. The present invention further contemplates a kit incorporating the rock-breaking tool, and a method of using the tool and kit to break rock by creating a small explosion in the bottom of a hole drilled in the rock. This type of drill hole is frequently referred to as a borehole. Presently, the kit contains the tool, a rubber bulb hole blower, hose, pump, two tapered drift pins, and an instruction manual. The kit may further contain a brush for cleaning the borehole.

The tool (12) for breaking hard material, according to the present invention, has a body (14) having an opening (16) therethrough forming a barrel (18). The barrel (18) has a top and a bottom (20 and 22), an opening (30) at the bottom (22) extending through the body (14), and a pressure input (44) for fluid communication into the barrel (18). The barrel (18) receives a piston (24) therein, and has a magnet (23) at the top (20) of the barrel (18). The magnet (23) is contiguous with the pressure input (44) allowing air to be pumped into the barrel (18) past the magnet (23). In the cocked position, the piston (24) is in contact with the magnet (23). An actuator pin tube (26) is received in the opening (30) at the bottom (22) of the barrel (18), and an actuator pin (38) is slidably engaged therein. A second opening (28) may be provided in the top ( ) of the barrel (18) for engaging the magnet (23), piston (24), actuator pin tube (26), and actuator pin (38).

A kit (110) containing the tool (12), hose (94), a package (120) of cartridges (84), a rubber bulb hole blower (112), two tapered drift pins (118), a borehole cleaning brush (122), an instruction manual (124), and a device (P) for communicating pressure into the hose taken from the group consisting of pump, bike pump, $CO_2$ cartridge, and the like. A method of using the tool (12) is also contemplated. Multiple tools (12) may be detonated at the same time by hooking them up to a manifold (95 or 95').

The present invention may be used by a large variety of potential users including excavators, blasting contractors, farmers, geologists, park trail builders, demolition contractors, prospectors, mining operations, road departments, landscapers, quarry operations, tactical personnel including police and armed services, structure collapse rescue teams, cave rescue and exploration groups. Equipment rental centers may also have use for such devices.

An aspect of the present invention is that the tool and method require very small diameter boreholes, which are typically about 0.375 inches or smaller, which can be more easily drilled by cheaper and more readily available consumer level equipment. Other methods of cracking hard material require the drilling of relatively large holes, generally an inch in diameter or larger. Alternatively, other methods require strenuous and often dangerous manual labor. The drilling equipment used to accomplish the other methods is expensive and generally requires high skill levels to operate.

Another aspect of the present invention is that the tool and method generate a relatively low energy output. This low energy output allows operators to use the tool and method in environments sensitive to the use of higher energy methods and devices.

Yet another aspect of the present invention is the portability of the tool. Since the device is quite small, it can be transported almost anywhere. An example of the usefulness of the small configuration of the tool is the potential use miles underground to open passages in caves for rescue or exploration. The tool easily fits into a hand held carry case with all the essential equipment needed to operate the tool.

A further aspect gained by the small size and relative simplicity of the system is its projected low cost to own and operate. This coupled with the elimination of large borehole drilling devices will allow many more people to successfully and economically deal with demolition problems in a far easier manner than has previously been available.

Since the tool's uses are not typically governed by blasting regulations and license requirements in most areas, the tool saves the users money by eliminating the expenses and logistics of hiring separate highly trained and licensed personnel. The tool also eliminates the risks of collateral damage to nearby property, which is always a concern when using high explosives. Many municipalities now have outright bans on the use of high power explosives within their jurisdictions which forces contractors to use track loader mounted hydraulic demolition hammers, pneumatic jack hammers, or expensive and slow acting hydraulic cements to crack materials. All of these methods can cost many times as much as using the present invention and can severely delay projects when unexpected obstacles are encountered.

Yet another aspect of the present invention is that several tools may be detonated simultaneously by using a manifold. This aspect of the present invention may facilitate precision blasting where very discrete breaks are desired. Such uses are beneficial in breaking rock associated with rescue, cave, trail, and the like, and elsewhere, especially where equipment must be carried manually.

These and other aspects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

Similar reference characters denote corresponding features consistently throughout the attached drawings.

DETAILED DESCRIPTION OF PREFERRED EMBODIMENTS

Figure 1:
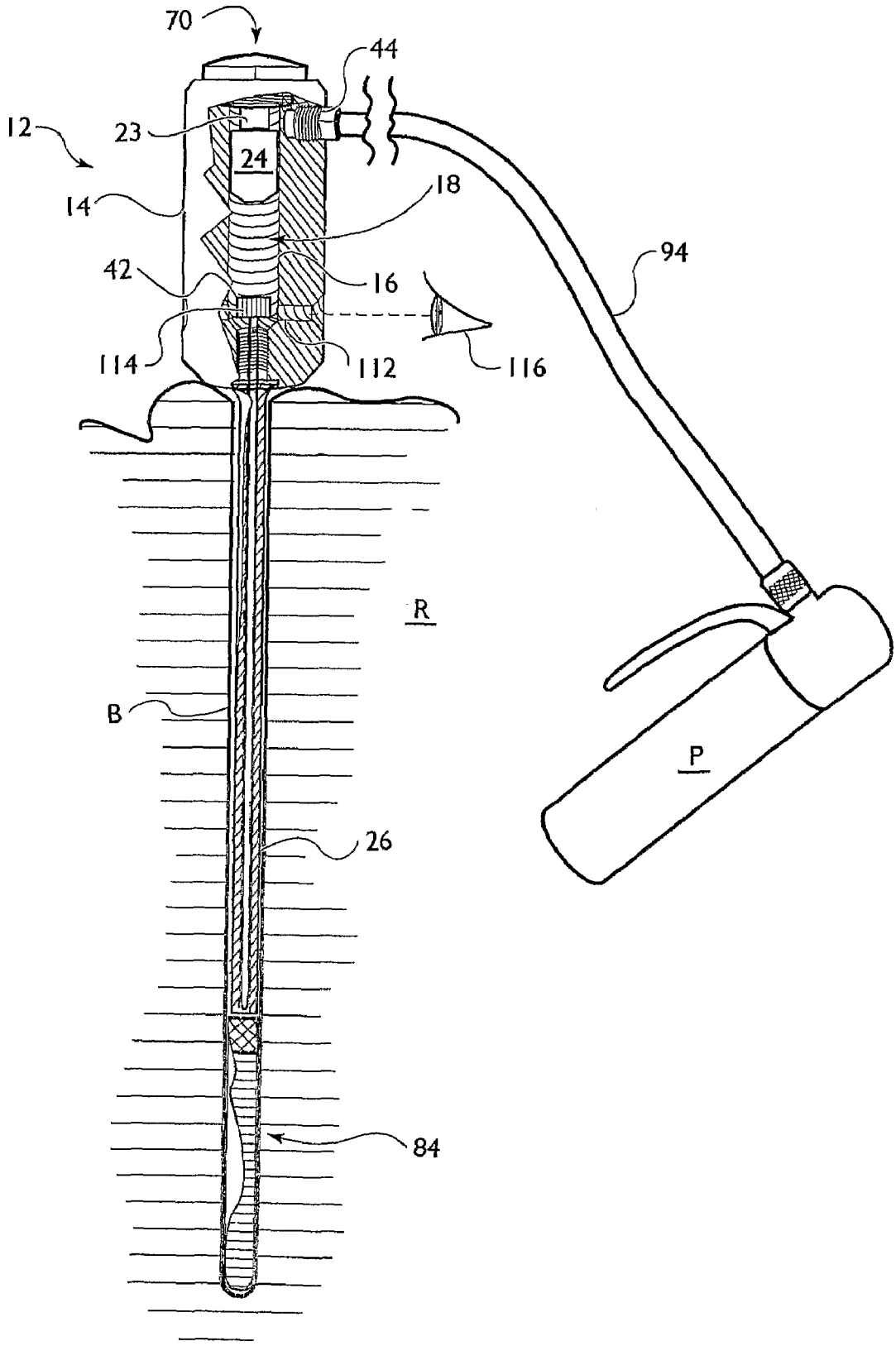
FIG. 1 is a sectional side view of the tool of the present invention engaged in a cutaway view of a borehole in a rock (R) showing the arrangement of the tool (12) armed with the actuator pin (38) of the tool (12) in contact with a cartridge (84) engaged in the cutaway borehole.
Figure 2:
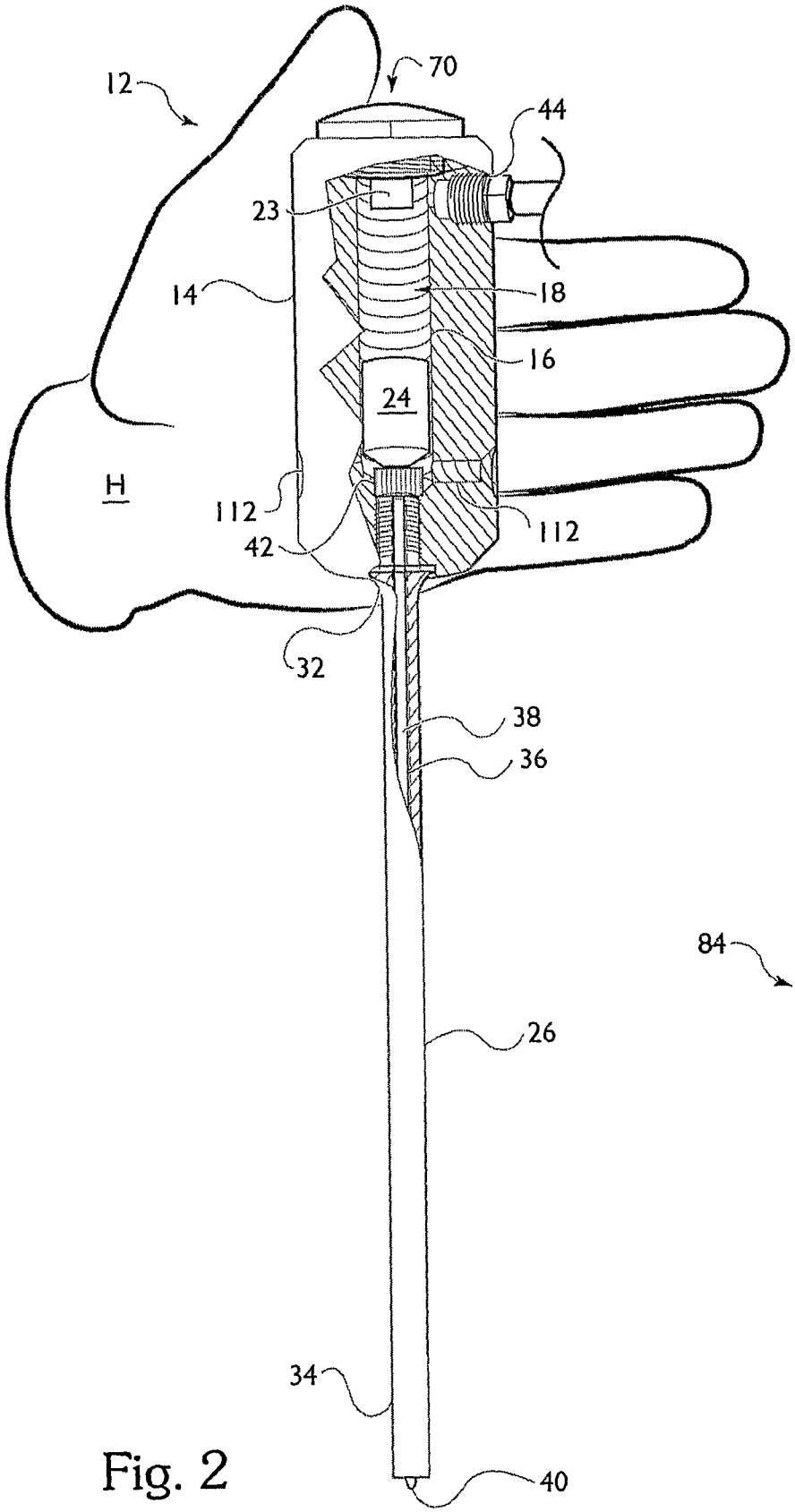
FIG. 2 is an environmental sectional side view of the tool (12), as shown in FIG. 1, in a discharge position.
Figure 3:
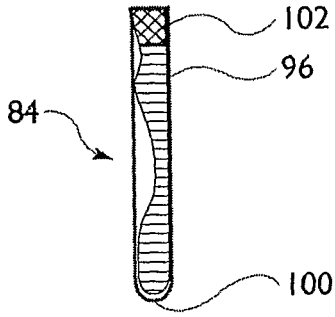
FIG. 3 is a sectional side view of a cartridge (84).

The present invention relates to a handheld tool (12), a kit containing the tool (110) and a method for the small scale cracking and demolition of solid materials, including by not limited to rock and masonry. The present invention further relates to a pneumatic-magnetic actuator. FIG. 1 shows the tool (12) of the present invention cocked, and ready to be used. FIG. 1 further depicts the tool (12) as used, by showing a cutaway of a borehole (B) in a rock (R) having the tool (12)

engaged and a cartridge (84) in the proper position in the borehole (B). FIG. 2 shows the tool (12) in an uncocked or released position. The tool (12) of FIG. 2 is shown relative to an average human hand (H) demonstrating the size of a preferred embodiment of the tool (12) of the present invention. Nonetheless, the tool (12) may be of different dimension and is not restricted to the general size shown. FIG. 3 is a view of the cartridge (84) used with the present invention. The cartridge (84) are also disclosed in the published patent application, US 2005/0257,675 A1, all of the contents of which are incorporated herein in their entirety by reference.

Figure 4:
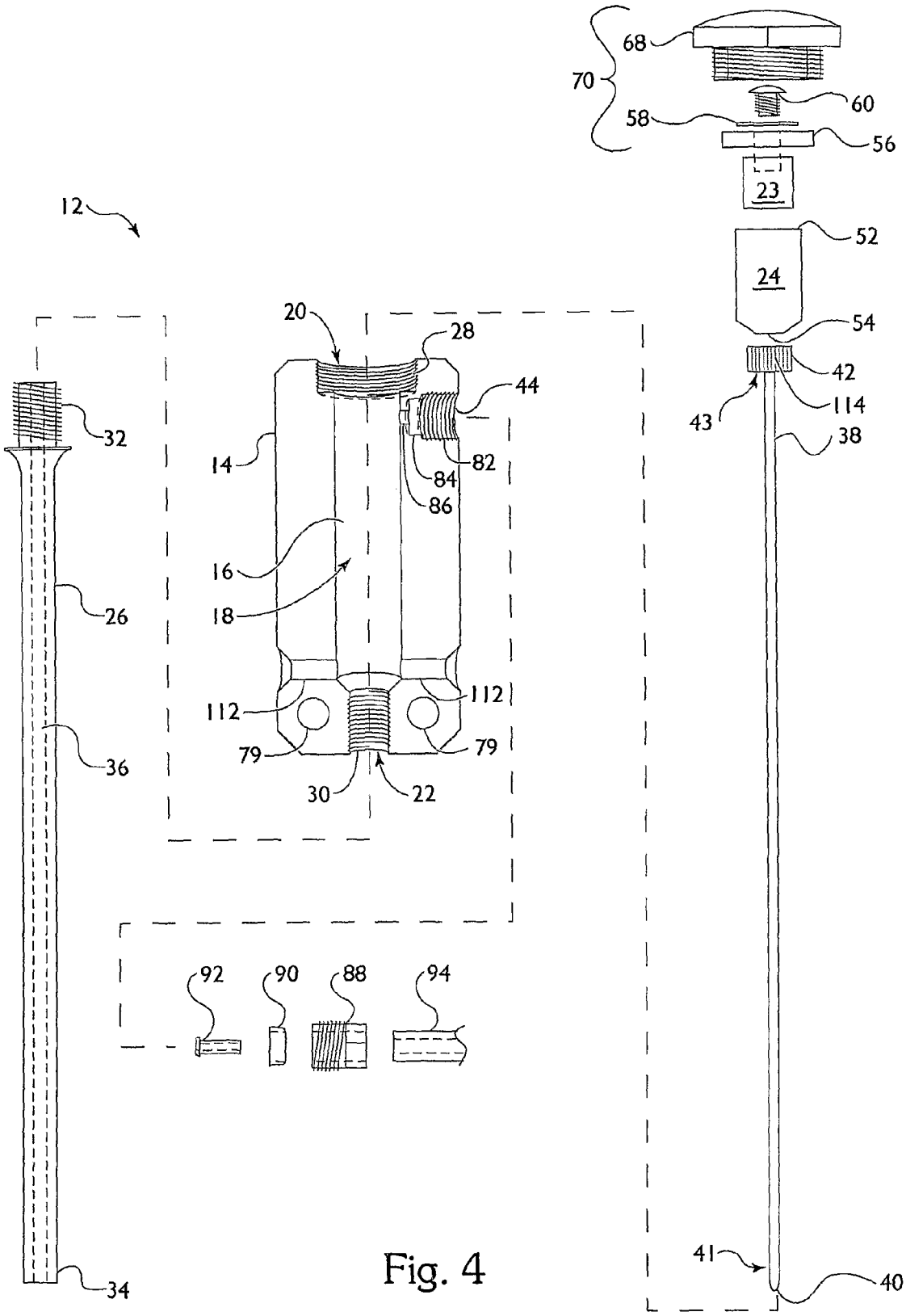
FIG. 4 is an exploded sectional view of the tool (12).
Figure 5A:
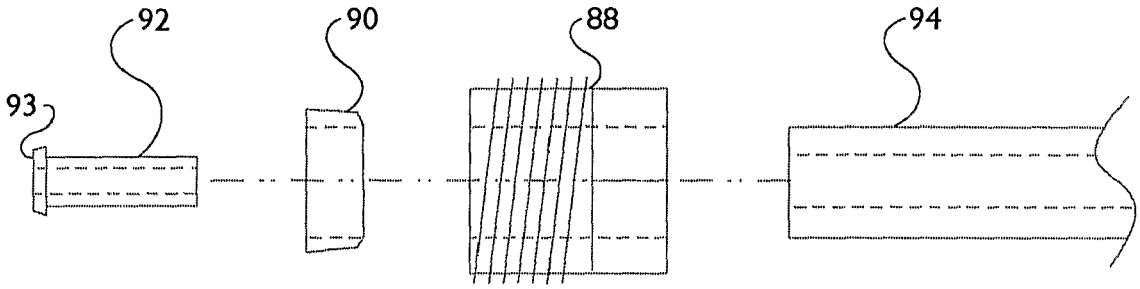
FIG. 5*a*-5*d* are views of the hose (94) and tool (12) connections optionally used to hold the hose (94) in fluid communication with the barrel (18) in accordance with the present invention.
Figure 5B:
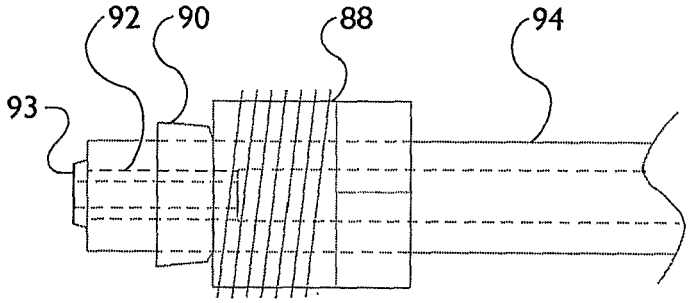
Figure 5C:
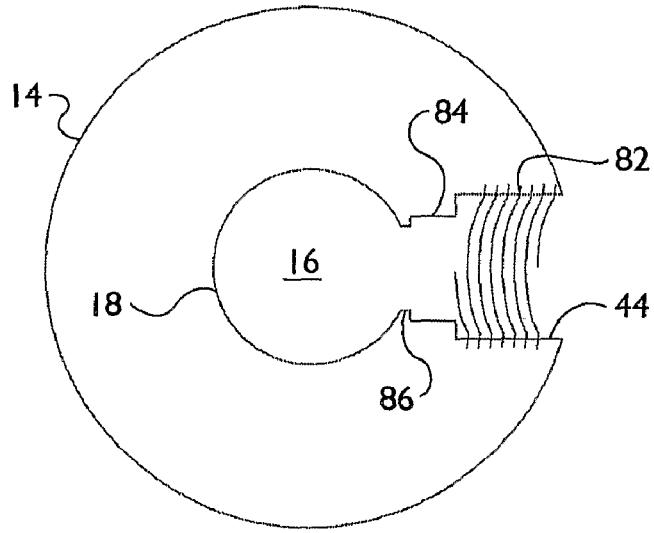
Figure 5D:
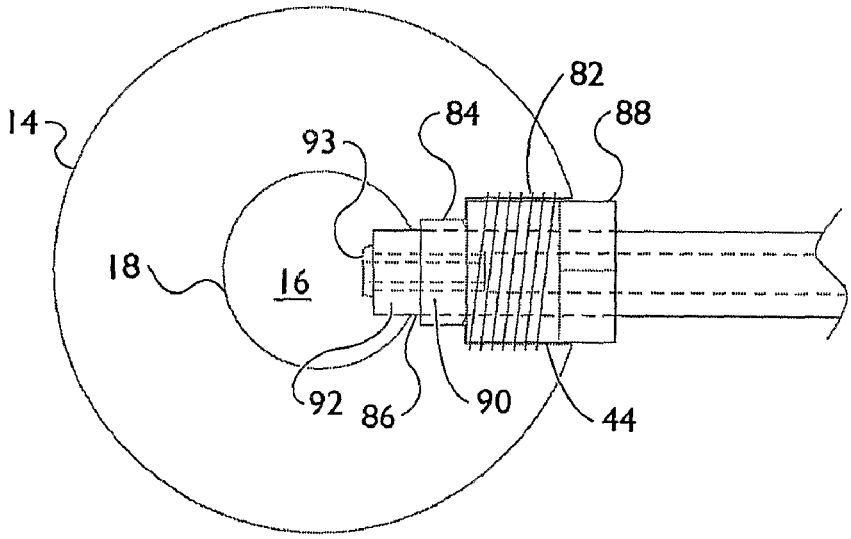

The tool (12) for breaking hard material, according to the present invention, has a body (14) having an opening (16) therethrough forming a barrel (18), which can be seen most clearly in the exploded view of the tool (12) depicted in FIG. 4. The barrel (18) has a top and a bottom (20 and 22), an opening (30) at the bottom (22) extending through the body (14), and a pressure input (44) for fluid communication into the barrel (18). The barrel (18) receives a piston (24) therein, and has a magnet (23) at the top (20) of the barrel (18). The magnet (23) is contiguous with the pressure input (44) allowing air to be pumped into the barrel (18) past the magnet (23). In the cocked position, shown in FIG. 1, the piston (24) is in contact with the magnet (23). In the released position, shown in FIG. 2, the piston (24) is in contact with a strike sensitive throw, such as a retention head (42) of an actuator pin (38), as discussed hereafter, adjacent the bottom (22) of the barrel (18). An actuator pin tube (26) is received in the opening (30) at the bottom (22) of the barrel (18).

As used herein, the term "barrel" is not limited to a cylindrical shape but may also encompass alternative shapes as long as opposing sides of the barrel are parallel thereby permitting the piston to move freely from the magnet (23) disposed at the first end of the barrel (18) to the second end thereof. The term "piston" is conventionally defined as a metallic cylinder sliding within a tube; specifically, a metallic cylinder that slides up and down inside a tubular housing, receiving pressure from or exerting pressure on a fluid. The piston (24) herein may be comprised of a ferrous metal attracted to a magnet, or of another composition having such a metal formed into the top of the piston (24). The barrel (18) of the present invention is analogous to the conventional tubular housing except that the barrel (18) need not be tubular but could instead have a square or oval cross section provided however that the piston (24) has a complimentary shape and may free slide up and down the barrel (18) from the magnet to strike the retention head (42) of the actuator pin (38).

In a preferred embodiment of the present invention, the body (14) may be comprised of carbon steel. The barrel (18) may be a 9/16-inch hole with the threaded opening (28) extending 3/8 inch into the barrel (18) wherein the entire barrel goes down 2 5/8 inches to the opening (30) at the bottom (22) of the barrel (18) with the fitted opening (30) extending therebelow. A second opening (28) may be disposed at the top (20) of the barrel (18) to allow the magnet (23) and the piston (24) to be inserted therethrough. In a preferred embodiment, the magnet (23) is disposed on a cap (70) engaged in the second opening (28) at the top (20) of the barrel (18). A preferred cap (70) has a screw (60) engaged in a washer (58) engaged in a rubber washer (56) with a plug (68) holding them in place relative to the barrel (18), as shown in FIG. 4.

The actuator pin tube (26) has a first end (32) and a second end (34). An opening (36) extends throughout the actuator pin tube (26) for slidably engaging an actuator pin (38). The first end (32) of the actuator pin tube (26) is engaged securely in the opening (30) at the bottom (22) of the barrel (18), and the second end (34) of the actuator pin tube (26) extends from the opening (30) at the bottom (22) of the barrel (18). The actuator pin tube (26), which may be composed of a hardened tool steel, may have an external diameter of 5/16 inch and an internal diameter of 1/8 inch, and a length of 8 1/2 inches with 8 inches exposed.

The actuator pin (38) has a tip (40) and a retention head (42) at opposing ends (41 and 43), as shown most clearly in FIG. 4. In a preferred embodiment, the retention head (42) may have a 1/4 inch diameter and be 1/8-inch long. The retention head (42) is wider than the opening (36) in the actuator pin tube (26). The actuator pin (38) is longer than the actuator pin tube (26) permitting the tip (40) to extend through the second end (34) of the actuator pin tube (26), as shown in FIG. 2. The actuator pin (38) may be 8 7/8 inches long with 1/8 inch diameter and a hemispherical tip (40).

The piston (24) has a top (52) and a bottom (54), and is slidably disposed in the barrel (18) between the magnet (23) and the retention head (42). The magnet (23) attracts and holds the top (52) of the piston (24) with a force M when in partial contact therewith. The pressure input (44) is in fluid communication with the top (52) of the piston (24) for forcefully dislodging the piston (24) upon applying pressure through the pressure input (44) such that the piston (24) strikes the retention head (42) forcing the tip (40) to strike the primer (102) disposed at the top of the cartridge (84), causing the propellant (96) to forcefully expand and crack the rock (R). The bottom (100) of the cartridge (84) is positioned in the borehole (B) such that the primer (102) is in contact with the tip (40). The bottom (54) of the piston (24) may have a complimentary shape to the bottom (22) of the barrel (18), as shown in FIGS. 1, 2, and 4.

The pressure input (44) is disposed substantially perpendicular to the barrel (18) and adjacent to the magnet (23). A tubing or hose (94) is in fluid communication with the pressure input (44) for increasing the pressure in the top (52) of the piston (24) so that the magnet (23) will release the piston (24) when magnetic flux is overcome allowing it to strike the head (42) of the pin (38). The pressure input (44) may be an opening and, in a preferred embodiment shown in FIGS. 5*a* through 5*d*, may have a first part (82) with a first diameter, a second part (84) with a second diameter that is narrower than the diameter of the first part (82), and an inner collar (86). The first part (82) may be threaded to accommodate a nut (88) with an external threaded fitting and an opening therethrough, the second part (84) may accommodate a thermo plastic angular ring (90) with an opening therethrough. The tubing or hose (94) extends through the nut (88), the angular ring (90) and the inner collar (86). The tubing (94) engaged in the opening may be further supported with an inner support tube (92) which keeps the hose or tubing (94) from collapsing when nut (88) is tightened. A collar (93) may be disposed on one end of the inner support tube (94) to prevent the tube (94) from becoming dislodged into the tubing or hose (94).

A means for generating pressure in fluid communication with the pressure input (44) is used to dislodge the piston (24) from the magnet (23). Typically, the tubing or hose (94) is in fluid communication with a pump (P) of some sort; however, any well know method of increasing pressure is contemplated hereby, including air compressors, air storage tanks, $CO_2$ cylinders, and the like. The term pump (P) as used herein incorporates any pressure source.

Additional modifications include the barrel (18) having at least one pressure output (112) disposed adjacent the bottom (22) of the barrel (18) allowing fluid pressure to be released from beneath the bottom (54) of the piston (24). The pressure output (112) may serve as a sighting mechanism for visually determining whether the actuator pin (38) is properly positioned. The pressure output (112) serves as a sight hole in the body (14) and a visual indicator (114) disposed on the retention head (42) of the actuator pin (38), wherein the visual indicator (114) is visible through the sight hole (112) when the actuator pin (38) is in proper position relative to a cartridge (84), as shown in FIG. 1. In operation, a person can see the visual indicator (114) through the output (112) when they position their eye (116) accordingly.

An anchor device which may comprise two anchor openings (79), shown in FIG. 4, designed to accommodate anchor cords, are disposed through the body (14). The two anchor openings (79) are disposed substantially perpendicular to the barrel (18), for applying restraining forces upon the tool (12) preventing the tool's (12) dislodgement do to the effect of gravity from a borehole (B) during detonation of cartridge (84). In a preferred embodiment, the anchor openings (79) may be ⅜-inch openings. Alternative anchor devices which can be attached to the body (14), as are well known, may be used. Such devices include holes extending though the body (14) as shown or in other positions, brackets attached to the body (14), or other means to hold the tool (12) in position.

The actuator mechanism of the present invention represents a one-way pneumatic actuator having a body (14) having an opening (16) therethrough forming a barrel (18). The barrel (18) has a top and a bottom (20 and 22), an opening (30) at the bottom (22) thereof, and a pressure input (44) for fluid communication into the barrel (18). The barrel (18) receives a piston (24) therein, and has a magnet (23) at the top (20) of the barrel (18) that is contiguous with the pressure input (44). The piston (24) has a top (52) and a bottom (54), and is slidably disposed in the barrel (18) between the magnet (23) and the opening (30). The magnet (23) attracts and holds the top (52) of the piston (24) with a force M when in partial contact therewith. The pressure input (44) is in fluid communication with the top (52) of the piston (24) for forcefully dislodging the piston (24) upon applying pressure through the pressure input (44) such that the piston (24) strikes the retention head (42). A strike sensitive throw, such as the actuator pin (38), is actuated by being struck by the bottom (54) of the piston (24) upon contact therewith. A second opening (28) may be disposed at the top (20) of the barrel (18), and the magnet (23) may be disposed on a cap (70) engaged in the second opening (28) at the top (20) of the barrel (18).

A method of breaking hard material using the tool (12), according to the present invention, involves providing a hose or tubing (94) in fluid communication with a pump (P) and the pressure input (44). A cartridge (84) is provided having a tubular shaped casing (96) with a closed bottom (100) at one end and a primer (102) at the opposing end and a propellant (98) interspersed therebetween the bottom (100) and the primer (102). A borehole (B) is drilled in a hard material (R) wherein the borehole (B) will accommodate the full length of the actuator pin tube (26) which extends from the opening (30) at the bottom (22) of the barrel (18). The borehole (B) is cleaned. An air blower (112) and a brush (122) may be used to thoroughly clean the borehole (B). The cartridge (84) is then inserted all the way into the borehole (B) so the primer (102) will come into contact with the tip (40) of the actuator pin (38) once the actuator pin tube (26) is engaged in the borehole (B). The tool (12) is shaken to assure free movement of the actuator pin (38) so that the tip (40) will slidably extend from the second end (34) of the actuator pin tube (26). The actuator pin tube (26) is then inserted into the borehole (B) such that the tip of the actuator pin (38) meets the primer (102) of the load cartridge (84). The hose (94) is then extended to its full length. The pump (P) is then activated to detonate the cartridge (84). The present invention is not limited to the pump (P) shown but may incorporate any other device for increasing pressure in the tubing (94).

Additionally, the actuator pin (28) is appropriately positioned relative to the bottom (42) of the piston (24) and the primer (102) of the load cartridge (84) by using a sighting mechanism (112) for visually determining whether the actuator pin (38) is properly positioned. Furthermore the tool (12) may be anchored by guiding cord through the openings provided. Additional mechanisms may be provided to evenly distribute forces, and retain the tool in the proper firing position.

Figure 6:
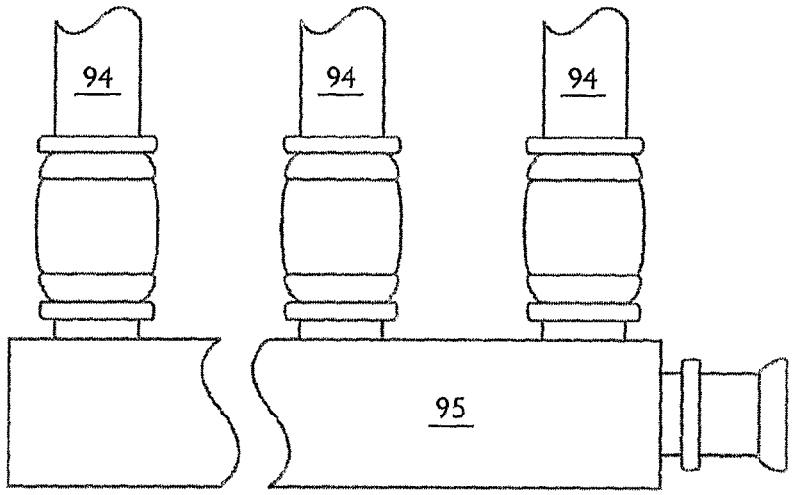
FIG. 6 is a side view of a manifold (95) that may be used with the present invention.
Figure 7:
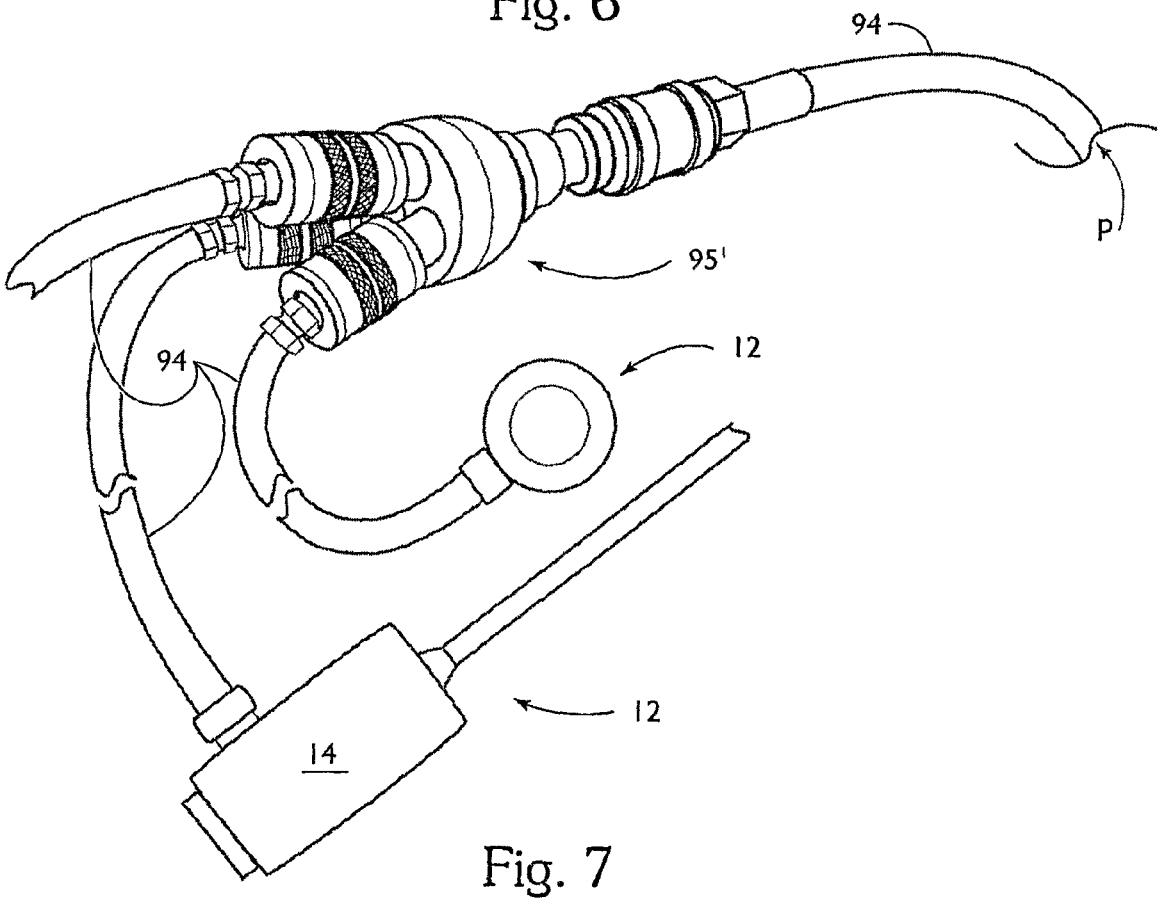
FIG. 7 is an environmental view of an alternative manifold (95') that may be used with the present invention.
Figure 8:
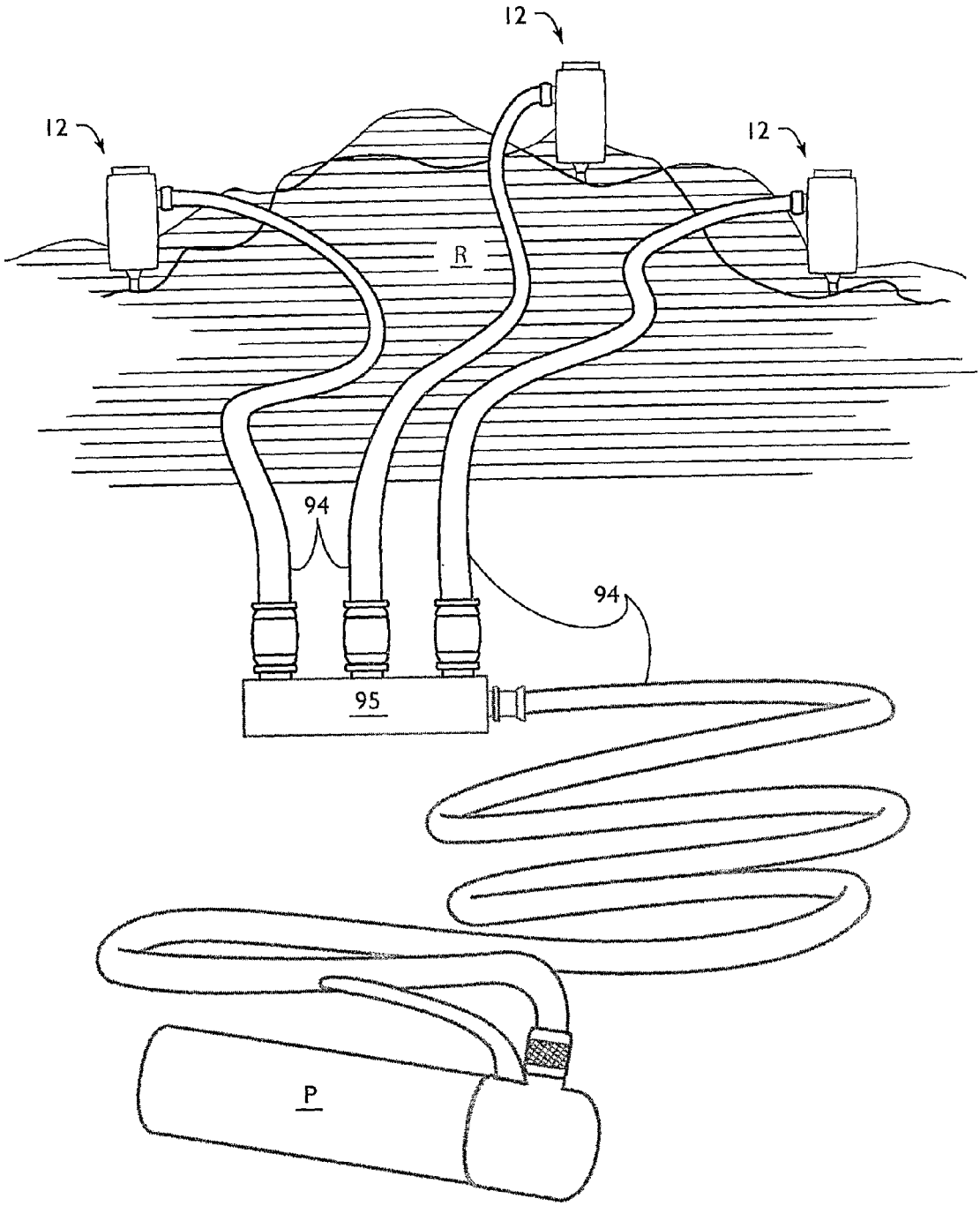
FIG. 8 is an environmental view of a manifold (95) used to break rock (R) at multiple positions.

A manifold (95 and 95') such as that shown in FIGS. 6 and 7 may be used to detonate multiple tools (12) at one time. FIG. 8 is an environmental view of a manifold (95) with three hoses (94) attached to it. Such manifolds (95 and 95') are well known, and may be provided with pressure release valves and control valves for proper operation. This permits the operator to eliminate pressure from the tool (12) to avoid unintentional actuation. Conventional manifold and quick connectors may be used to connect the hose in a conventional manner. A manifold with a three way slide valve may be used as is well known in the art. This allows resetting the pneumatic rock breaking tool (12) without having to disconnect the tools (12) from the hose (94). The term "manifold" is not limited to the examples shown here and is seen to cover any pipe fitting with several lateral outlets for connecting one pipe with others that distributes the air flow from the one pipe evenly to the other pipes. The tool (12) is reset by turning it upside-down allowing the piston (24) to contact the magnet (23).

Figure 9:
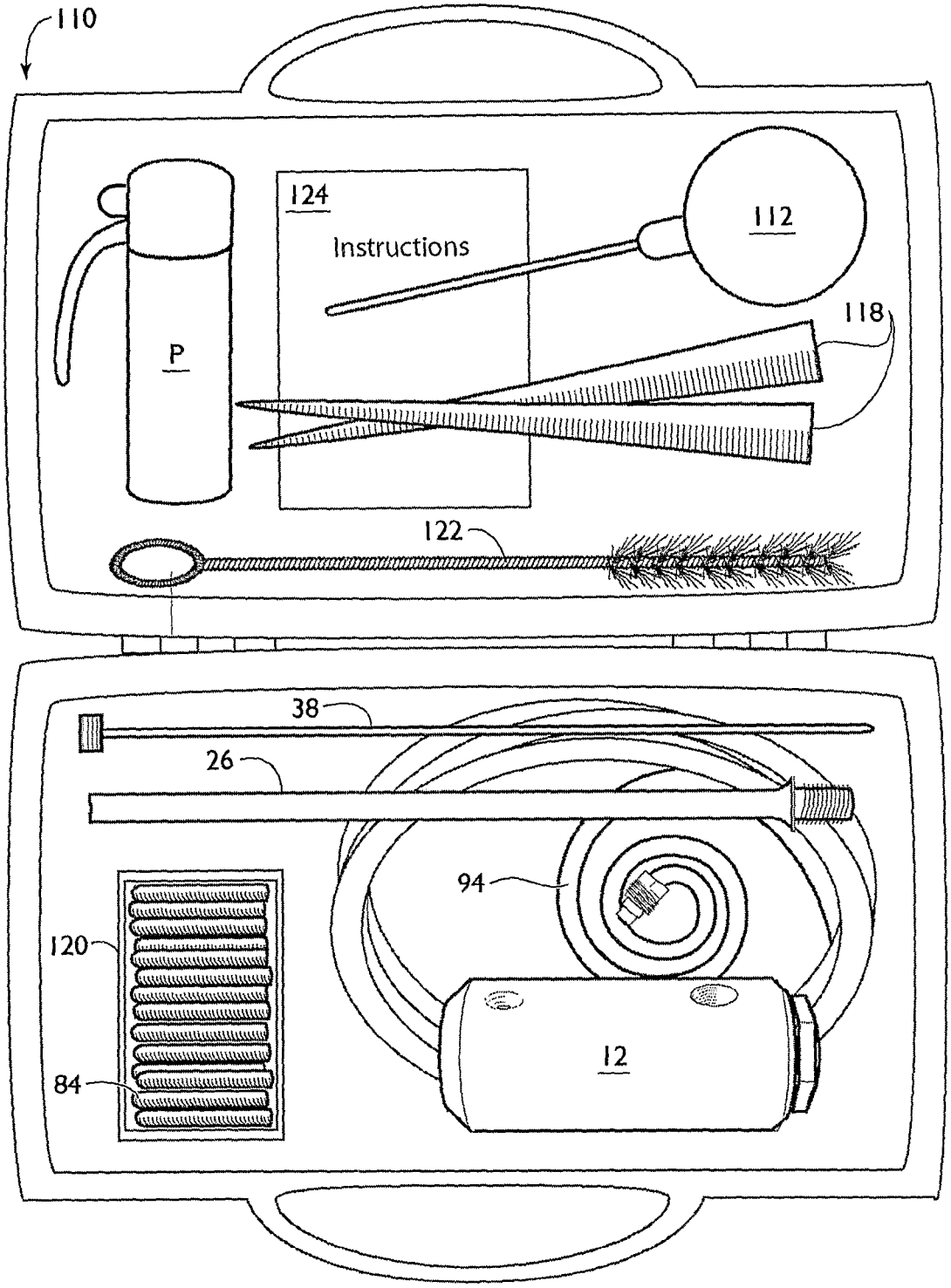
FIG. 9 is a top view of a kit (110) containing the tool (12) according to the present invention.

A kit (110) containing a pneumatic rock breaking tool (12) is shown in FIG. 9. The kit may contain a rubber bulb hole blower (112), two tapered drift pins (118) for wedging apart cracked material, a borehole cleaning brush (122), an instruction manual (124), and a pump (P) for communicating pressure into the hose (94) such as a bike pump, $CO_2$ cartridge, and the like. A small cylinder of $CO_2$ may be used as an alternative pressure source to trigger the system. Commercially available 12 and 20 ounce $CO_2$ cylinder coupled with available pressure regulator feeding manifold/valve system may be advantageous. Pneumatic quick-connect couplings or other equivalent couplings may be used to connect the hose to the air pressure supply and the manifold, if present.

It is to be understood that the present invention is not limited to the embodiments described above, but encompasses any and all embodiments within the scope of the following claims.

What is claimed is:

1. A tool (12) for breaking hard material, comprising:

a. a body (14) having an opening (16) therethrough forming a barrel (18), wherein the barrel (18) has a top and a bottom (20 and 22), an opening (30) at the bottom (22) thereof, and a pressure input (44) for fluid communication into the barrel (18), and the barrel (18) receives a piston (24) therein, and has a magnet (23) at the top (20) of the barrel (18), which magnet (23) is contiguous with the pressure input (44);

b. an actuator pin tube (26) having first and second ends (32 and 34), and an opening (36) therethrough for slidably engaging an actuator pin (38), wherein the first end (32) of the actuator pin tube (26) is engaged securely in the opening (30) at the bottom (22) of the barrel (18), and the second end (34) of the actuator pin tube (26) extends from the opening (30) at the bottom (22) of the barrel (18);

c. the actuator pin (38) having a tip (40) and a retention head (42) at opposing ends (41 and 43) thereof, wherein the retention head (42) is wider than the opening (36) in the actuator pin tube (26), and the actuator pin (38) is longer than the actuator pin tube (26) permitting the tip (40) to extend through the second end (34) of the actuator pin tube (26); and d. the piston (24) having a top (52) and a bottom (54), and being slidably disposed in the barrel (18) between the magnet (23) and the retention head (42), wherein the magnet (23) attracts and holds the top (52) of the piston (24) with a force M when in partial contact therewith and the pressure input (44) is in fluid communication with the top (52) of the piston (24) for forcefully dislodging the piston (24) upon applying pressure through the pressure input (44) such that the piston (24) strikes the retention head (42).

2. The tool (12) of claim 1, further comprising:

a. a second opening (28) at the top (20) of the barrel (18), wherein b. the magnet (23) is disposed on a cap (70) engaged in the second opening (28) at the top (20) of the barrel (18).

3. The tool (12) of claim 1, wherein:

a. the bottom (54) of the piston (24) has a complimentary shape to the bottom (22) of the barrel (18).

4. The tool (12) of claim 1, wherein:

a. the pressure input (44) is disposed substantially perpendicular to the barrel (18) and adjacent the magnet (23).

5. The tool (12) of claim 1, wherein:

a. the pressure input (44) is an opening having a first part (82) with a first diameter, a second part (84) with a second diameter narrower than the first part (82), and an inner collar (86) wherein the first part (82) is threaded to accommodate a nut (88) with an external threaded fitting, the second part (84) accommodates an angular ring (90), and the nut (88), the angular ring (90) and the inner collar (86) all receive the hose (94) therethrough.

6. The tool (12) of claim 5, wherein:

a. the tubing (94) adjacent the inner collar (86) receives an inner support tube (92) therethrough.

7. The tool (12) of claim 6, wherein a. a collar (93) is disposed on one end of the inner support tube (94).

8. The tool (12) of claim 1, further comprising:

a. a hose (94) in fluid communication with the pressure input (44).

9. The tool (12) of claim 1, further comprising:

a. a means for generating pressure in fluid communication with the pressure input (44).

10. The tool (12) of claim 1, wherein:

a. the barrel (18) has at least one pressure output (112) disposed adjacent the bottom (22) of the barrel (18).

11. The tool (12) of claim 1, further comprising:

a. a pressure output opening (112) serving as a sighting mechanism for visually determining whether the actuator pin (38) is properly positioned in the body (14) and a visual indicator (114) disposed on the retention head (42) of the actuator pin (38), wherein the visual indicator (114) is visible through the pressure output opening (112) when the actuator pin (38) is in proper position relative to a load cartridge (84).

12. The tool (12) of claim 8, further comprising:

a. an anchoring means for preventing the tool (12) from becoming dislodged due to gravity.

13. A one-way pneumatic actuator, comprising:

a. a body (14) having an opening (16) there through forming a barrel (18), b. the barrel (18) having a top and a bottom (20 and 22), an opening (30) at the bottom (22) thereof, and a pressure input (44) for fluid communication into the barrel (18), wherein the barrel (18) receives a piston (24) therein, and has a magnet (23) at the top (20) of the barrel (18), which magnet (23) is contiguous with the pressure input (44); wherein the pressure input (44) is an opening having a first part (82) with a first diameter, a second part (84) with a second diameter narrower than the first part (82), and c. the piston (24) having a top (52) and a bottom (54), and being slidably disposed in the barrel (18) between the magnet (23) and the opening (30), wherein the magnet (23) attracts and holds the top (52) of the piston (24) with a force M when in partial contact therewith and the pressure input (44) is in fluid communication with the top (52) of the piston (24); and d. a strike sensitive throw which is actuated upon being struck by the bottom (54) of the piston (24).

14. The actuator of claim 13, further comprising:

a. a second opening (28) at the top (20) of the barrel (18), wherein b. the magnet (23) is disposed on a cap (70) engaged in the second opening (28) at the top (20) of the barrel (18).

15. The actuator of claim 13, wherein:

a. the bottom (54) of the piston (24) has a complimentary shape to the bottom (22) of the barrel (18).

16. The actuator of claim 13, wherein:

a. the pressure input (44) is disposed substantially perpendicular to the barrel (18) and adjacent the magnet (23).

17. The actuator of claim 13, further comprising:

a. an inner collar (86) wherein the first part (82) of the pressure input (44) is threaded to accommodate a nut (88) with an external threaded fitting, the second part (84) accommodates an angular ring (90), and the nut (88), the angular ring (90) and the inner collar (86) all receive the hose (94) there through.

18. The tool (12) of claim 13, wherein:

a. the barrel (18) having at least one pressure output (112) disposed adjacent the bottom (22) of the barrel (18).

19. A kit (110) containing a pneumatically triggered tool (12) for breaking rock, comprising:

a. a tool (12) for breaking hard material (R), tubing (94), and a package (120);

b. wherein the tool (12) comprises i. a body (14) having an opening (16) therethrough forming a barrel (18), wherein the barrel (18) has a top and a bottom (20 and 22), an opening (30) at the bottom (22) thereof, and a pressure input (44) for fluid communication into the barrel (18), and the barrel (18) receives a piston (24) therein, and has a magnet (23) at the top (20) of the barrel (18), which magnet (23) is contiguous with the pressure input (44);

ii. an actuator pin tube (26) having first and second ends (32 and 34), and an opening (36) therethrough for slidably engaging an actuator pin (38), wherein the first end (32) of the actuator pin tube (26) is engaged securely in the opening (30) at the bottom (22) of the barrel (18), and the second end (34) of the actuator pin tube (26) extends from the opening (30) at the bottom (22) of the barrel (18);

iii. the actuator pin (38) having a tip (40) and a retention head (42) at opposing ends (41 and 43) thereof, wherein the retention head (42) is wider than the opening (36) in the actuator pin tube (26), and the actuator pin (38) is longer than the actuator pin tube (26) permitting the tip (40) to extend through the second end (34) of the actuator pin tube (26); and iv. the piston (24) having a top (52) and a bottom (54), and being slidably disposed in the barrel (18) between the magnet (23) and the retention head (42), wherein the magnet (23) attracts and holds the top (52) of the piston (24) with a force M when in contact therewith, and the pressure input (44) is in fluid communication with the top (52) of the piston (24).

20. The kit according to claim 19, further comprising:

a. a rubber bulb hole blower (112), two tapered drift pins (118), a borehole cleaning brush (122), an instruction manual (124), and a pump (P) for communicating pressure into the hose (94).

21. A method of breaking hard material, comprising the steps of:

a. providing a tool (12) for breaking hard material, wherein the tool (12)

i. comprises a body (14) having an opening (16) therethrough forming a barrel (18), wherein the barrel (18) has a top and a bottom (20 and 22), an opening (30) at the bottom (22) thereof, and a pressure input (44) for fluid communication into the barrel (18), and the barrel (18) receives a piston (24) therein, and has a magnet (23) at the top (20) of the barrel (18), which magnet (23) is contiguous with the pressure input (44);

ii. an actuator pin tube (26) having first and second ends (32 and 34), and an opening (36) therethrough for slidably engaging an actuator pin (38), wherein the first end (32) of the actuator pin tube (26) is engaged securely in the opening (30) at the bottom (22) of the barrel (18), and the second end (34) of the actuator pin tube (26) extends from the opening (30) at the bottom (22) of the barrel (18);

iii. the actuator pin (38) having a tip (40) and a retention head (42) at opposing ends (41 and 43) thereof, wherein the retention head (42) is wider than the opening (36) in the actuator pin tube (26), and the actuator pin (38) is longer than the actuator pin tube (26) permitting the tip (40) to extend through the second end (34) of the actuator pin tube (26); and iv. the piston (24) having a top (52) and a bottom (54), and being slidably disposed in the barrel (18) between the magnet (23) and the retention head (42), wherein the magnet (23) attracts and holds the top (52) of the piston (24) with a force M when in contact therewith and the pressure input (44) is in fluid communication with the top (52) of the piston (24);

b. providing a hose (94) in fluid communication with a pump (P) and the pressure input (44);

c. providing a cartridge (84) having a tubular shaped casing (96) with a closed bottom (100) at one end and a primer (102) at the opposing end and a load (98) interspersed therebetween the bottom (100) and the primer (102);

d. drilling a borehole (B) in a hard material (R) wherein the borehole (B) will accommodate the full length of the actuator pin tube (26) which extends from the opening (30) at the bottom (22) of the barrel (18);

e. cleaning out the borehole;

f. shaking the tool (12) to ensure free movement in the actuator pin (38);

g. inserting the load cartridge (84) all the way into the borehole (B) so the primer (102) will come into contact with the tip (40) of the actuator pin (38) once the actuator pin tube (26) is engaged in the borehole (B);

h. inserting the actuator pin tube (26) into the borehole (B) such that the tip (40) of the actuator pin (38) meets the primer (102) of the cartridge (84);

i. extending the hose (94) to its full length; and j. communicating the pressure in the hose (94) to detonate the cartridge (84).

22. The method according to claim 21, further comprising the step of:

a. verifying that the actuator pin (28) is appropriately positioned relative to the hammerhead (50) and the primer (102) of the load cartridge (84), wherein the tool (12) further comprises a sighting mechanism (81) for visually determining whether the actuator pin (38) is properly positioned.

23. The method according to claim 21, further comprising the step of:

a. anchoring the tool (12) in position engaged in the borehole (B).

24. The method according to claim 21, wherein:

a. a manifold (95 or 95') is provided, and b. at least one tool (12) is in fluid communication with the manifold (95 or 95') and in fluid communication with a pump (P).

* * * * *